United States Patent [19]

Fliss

[11] Patent Number: 4,941,239

[45] Date of Patent: Jul. 17, 1990

[54] METHOD TO REDUCE FORMING FABRIC EDGE CURL

[75] Inventor: Thomas A. Fliss, Montgomery, Ala.

[73] Assignee: Albany International Corporation, Menands, N.Y.

[21] Appl. No.: 310,738

[22] Filed: Feb. 14, 1987

[51] Int. Cl.[5] ..... D21G 9/00

[52] U.S. Cl. ..... 26/28

[58] Field of Search ..... 26/28, 29 R, 31, 98; 139/383 A

[56] References Cited

U.S. PATENT DOCUMENTS

| | | | |
|---|---|---|---|
| 2,277,937 | 3/1942 | Shryer | 26/28 |
| 3,573,164 | 3/1971 | Friedberg et al. | 139/383 A R |
| 3,905,863 | 9/1975 | Ayers | 139/425 A R |
| 3,974,025 | 8/1976 | Ayers | 139/425 A R |
| 4,012,815 | 3/1977 | Benzaquen | 26/28 |
| 4,191,609 | 3/1980 | Trokham | 162/113 |
| 4,239,065 | 12/1980 | Trokham | 139/383 A |
| 4,426,795 | 1/1984 | Rudt | 139/383 A R |
| 4,480,362 | 11/1984 | Maxwell | 26/28 |
| 4,494,319 | 1/1985 | Rudt | 139/383 A R |

FOREIGN PATENT DOCUMENTS

| | | | |
|---|---|---|---|
| 1083365 | 4/1986 | Japan | 26/29 R |

*Primary Examiner*—Werner H. Schroeder
*Assistant Examiner*—Bradley Kurtz DeSandro
*Attorney, Agent, or Firm*—Kane, Dalsimer, Sullivan, Kurucz, Levy, Eisele, & Richard

[57] ABSTRACT

This disclosure describes a method by which an edge curl that often develops in papermachine forming fabrics can be reduced or eliminated. The method requires the removal of mass from the sheet forming side of the forming fabric. This has the effect of reducing the ratio between the shrink forces acting on the two sides of the forming fabric in the cross-machine direction and, in turn, reduces the tendency for shrinkage to cause the edges of the fabric to curl. Papermachine operational problems associated with edge curl are thereby reduced.

16 Claims, 2 Drawing Sheets

FIG. 3
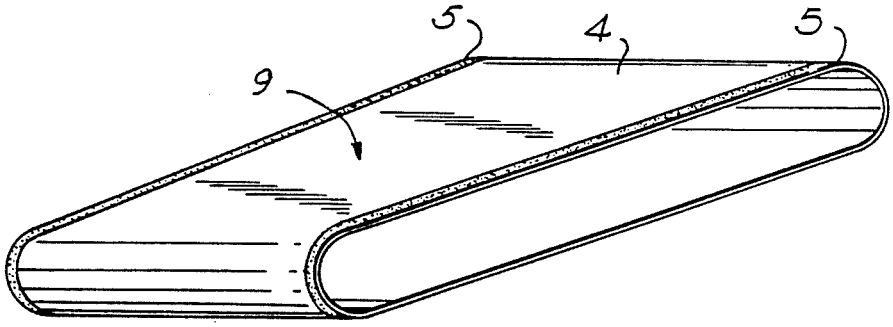
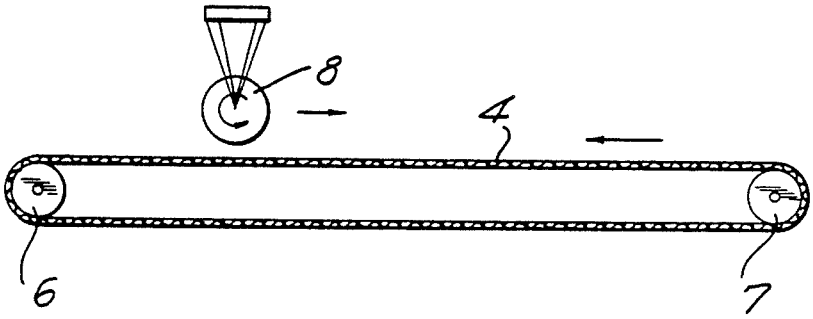
FIG. 4

METHOD TO REDUCE FORMING FABRIC EDGE CURL

BACKGROUND OF THE INVENTION

1. Field of the Invention

This invention relates to the fabrics used as forming media in modern papermaking machines More particularly, a method for treating a forming fabric in order to reduce or eliminate the problem of edge curl is disclosed.

2. Description of the Prior Art

Broadly stated, the purpose of modern papermaking machines is to remove water from a stock or furnish consisting of an aqueous suspension of wood fibers and a variety of other ingredients Generally, modern papermachines are made up of three distinct sections.

The first is the forming section, where the furnish is applied to a moving screen, traditionally referred to in the industry as a wire. The wire's screen-like construction enables water to drain readily from the furnish leaving a web of wet wood fiber on its upper surface.

At the end of the forming section, enough water has drained from the wet wood fiber that it assumes the form of a wet sheet of sufficient structural integrity to be transferred to a press fabric. The wet sheet is carried on to the press section either atop this single press fabric or sandwiched between two such fabrics. The press fabrics serve the purpose of removing further amounts of water from the wet sheet. Here, however, because the water that remains will not drain from the sheet on its own accord, the combination of fabric and wet sheet are passed together through a series of presses where water is squeezed from the sheet and accepted by the fabrics. A common press design incorporates two adjacent rollers, forming a narrow gap or nip. The gap width can be adjusted to provide different levels of compression in the nip. The same time, the smooth, hard surfaces of the press fabrics impart a finish to the wet sheet being gradually transformed into a paper product.

At the end of the press section, the wet sheet proceeds to the final stage of the papermachine, the dryer section. There, the sheet is conducted or passed around each in a series of cylinders steam-heated from within. Whatever water still remains in the sheet is gradually driven off by evaporation upon contact with the hot cylinders. Fabrics are employed in this section as well. Here, however, they do not so much carry or conduct the sheet as serve to hold the sheet in intimate contact with the surface of each cylinder as an aid to efficient drying.

The fabrics used in each section take the form of long, continuous, endless moving belts. They are either woven in endless form or seamed into that form. Depending on the papermachine, the belts can be from 1 to 10 meters wide and of considerably longer total length.

As stated rather implicitly above, the paper manufacturing operation is continuous. In other words, furnish is continuously applied to the wire, forming a wet sheet which is transferred, in turn, to the press and dryer section, emerging finally as some form of paper product.

The fabrics used in the forming stage will be our chief concern here. The forming fabrics, or wires, play a crucial role in the papermaking process. They must be highly permeable and allow large quantities of water to drain quickly from the furnish, and must be of a weave to assure optimum sheet formation. Of equal importance, the upper surface of the forming fabric, to which the furnish is applied, should be as smooth as possible in order to assure the formation of a smooth, unmarked sheet.

Formerly, the fabrics used in the forming section were woven from metal threads. For this reason, they are still commonly referred to in the papermaking industry as wires, even though most are now woven from synthetic monofilament.

A wide variety of these fabrics are in current use, and can be characterized by weave pattern and number of layers. One chooses a particular fabric to meet the requirements of the machine on which it is to be installed and the kind of paper to be produced.

Generally, the systems of yarns in a woven fabric lie in directions which can be referred to as the warp and weft. They can also be labelled with reference to the directions they take when the fabric is in its position of use on the papermachine. The machine direction yarns lie in the direction in which the fabric as a whole moves when the machine is operating and, accordingly, must bear forces of tension associated with this motion.

Transverse to the machine direction yarns are cross-machine direction yarns. By contrast, the cross-machine direction yarns are subjected to very little, if any, tension on the papermachine.

The relationship between the machine direction and cross-machine direction nomenclature, and the more general warp and weft terminology, depends upon the manner in which the fabric has been woven. For example, a seamed fabric is flat woven; in this case the warp yarns in the weaving process become the machine direction yarns in the seamed fabric.

In some of the weave patterns in current use, the cross-machine direction yarns pass over more than one machine direction yarn before weaving under one such yarn and repeating the pattern. A fabric is thereby produced having an upper surface formed primarily from the cross-machine yarns or shutes. Normally, this side is used for the formation of the paper sheet, and can be referred to as the long-shute knuckle side.

An undesired consequence of such weave patterns is that the forming fabrics so characterized tend to curl in a direction toward the long-shute knuckle side with time as back side wear and/or shrinkage occurs. The curl arises because these cross-machine weave patterns result in the shrink forces on each side of the upper surface being unequal. The resulting curl can cause operation problems on the papermachine.

The present invention supplies a solution to the problem of forming fabric edge curl.

SUMMARY OF THE INVENTION

The present invention is an application of the observation that, if some mass is removed from the cross-machine strands on the long-shute knuckle side of the forming wire, the tendency of the fabric to curl upon shrinkage of the cross-machine strands will be reduced. In other words, the cross-machine direction strands on the sheet side will tend to shrink less, and the ratio of the shrink forces on the two sides of the forming wire will approach unity. In consequence, curling will be reduced or eliminated.

In practice, one could do this on the entire long-shute knuckle side of the forming fabric. However, as this would likely have an adverse effect on its paper forming properties, it is preferable to treat regions lying in a band along the edges of the forming fabrics of a width that will not extend into the central region used in paper production. In this way, edge curl could be reduced without harming the paper forming characteristics of the fabric.

The mass is removed by using a fine abrasive medium on the surface of the fabric, as will be described below. Typically, one-fourth of the mass may be removed in this manner.

While the present invention is described in detail below as applied to a single-layered forming fabric of a specific weave, it should be clearly understood that it can be generally applied to reduce edge curl in all kinds of forming fabrics, both single- and multi-layered.

BRIEF DESCRIPTION OF THE DRAWINGS

FIG. 3 is a perspective view of a forming fabric showing the bands lying along its edge which should be treated in accordance with the method disclosed here to reduce edge curl.

FIG. 4 is a side view of a forming fabric mounted and under tension on a finishing table. Its surface is being machined in the manner disclosed here to reduce edge curl.

DETAILED DESCRIPTION OF THE PREFERRED EMBODIMENT

Figure 1:
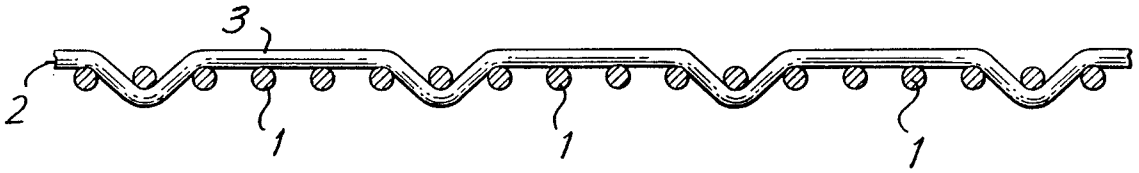
FIG. 1 is a cross-sectional view, taken in the machine direction, of the upper surface of a typical modern forming fabric, where the cross-machine direction strand is woven in an under one and over four (1×4) pattern.
Figure 2:
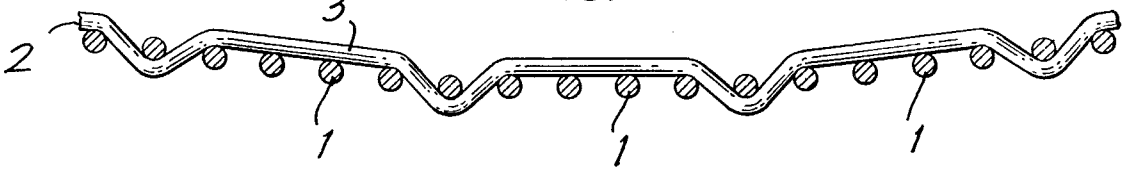
FIG. 2 is the same view as that shown in FIG. 1 taken after shrinkage in the cross-machine direction has resulted in edge curl. The amount of curl has been exaggerated for the purpose of illustration.

To illustrate the edge curl problem that can be reduced by the method of this invention, we will first turn to FIGS. 1 and 2. FIG. 1 presents a cross-sectional view of a forming fabric made up of monofilament machine-direction yarns 1 interwoven with monofilament cross-machine direction yarns 2. The long-shute knuckle side 3, often used to form the paper sheet, is characterized by shute knuckles that are broad and flat. This is a consequence of the 1×4 weave pattern in which the cross-machine direction yarn 2 spans four machine-direction yarns 1 for each one it weaves under.

The fact that most of the length of the cross-machine direction yarn 2 lies on the long-shute knuckle side 3 of the machine direction yarn 1 results in the forces acting upon the fabric in the cross-machine direction when shrinkage occurs being unequal. The rather exaggerated curl shown in FIG. 2 results. The method disclosed here is an attempt to remedy this effect.

FIG. 3 is a perspective view of a typical endless forming fabric 4. In order that the paper forming properties of the fabric not be adversely affected, it is preferred not to treat the entire surface of the fabric in the way proposed here. Rather, some mass should be removed from the long-shute knuckle side 3 in bands 5 adjoining the edges of the forming fabric. The width of the bands 5 would be chosen to be only as large as would not extend into the central region of the upper surface 9 of the forming fabric 4 actually used to form the paper sheet.

The method of the present invention can be practiced as follows. Referring to FIG. 4, the forming fabric 4, either woven in endless form or joined into such a form by seaming, is mounted on a finishing table, which consists of a first roller 6 and a second roller 7, which can be moved apart to place the forming fabric 4 under tension.

A fine abrasive medium, such as 400-grit sandpaper, is mounted on a third roller 8, suspended above the forming fabric 4 and powered by a motor or other power source, not shown. The third roller 8 is then brought into slight grazing contact with the forming fabric and operated in order to remove by means of abrasion a slight amount of mass from the long-shute knuckles Typically, this process would be carried out by having the third roller 8 move in one direction while the finishing table rollers 6, 7 move the forming fabric 4 in the opposite direction, as indicated by the arrows in FIG. 4.

A hand-held power tool could alternatively be used to carry out the sanding operation.

As illustrated in the example below, a sanding operation in which a quarter of the diameter of the long-shute knuckles in a band adjoining an edge of the forming fabric is removed results in a less pronounced edge curl.

EXAMPLE

To test the disclosed method, a 94 mesh by 95 count 5-shed (1×4) single-layer fabric was surfaced on the long shute knuckle side in a 4-inch band along one edge. By removing 0.0015 inches from the 0.0060-inch diameter cross-machine direction strands, edge curl was reduced from 1 ⅛ inch upward to ⅝ inch upward.

Although the method provided by the present invention has been applied as above to a single-layered forming fabric of specific weave, it should be understood by the reader that it can be applied as well to other kinds of forming fabrics, both single- and multi-layered, having weave patterns such that edge curl may arise in response to unbalanced forces produced across the fabric by the shrinkage of cross-machine direction (CD) yarns. In general, then, one would treat the fabric as disclosed herein on the paper- supporting side of the fabric.

Modifications would be obvious to one skilled in the art without departing from the scope of the invention as defined in the appended claims.

I claim:

1. A method for reducing forming fabric edge curl comprising:

maintaining a forming fabric in a substantially flat condition, said forming fabric woven from machine direction and cross-machine direction yarns in a pattern producing a surface on said fabric formed substantially by said cross-machine direction yarns, said surface being a long-shute knuckle side of said fabric; and removing mass from the long-shute knuckle side of the substantially flat forming fabric so that the ratio of the shrink forces acting on the two sides of the forming fabric will be reduced, said mass being removed from said long-shute knuckle side in a band inwardly from an edge of said forming fabric for the length of said forming fabric.

2. The method as recited in claim 1 wherein the forming fabric is maintained in a substantially flat condition by placing said forming fabric in endless form around a first roller and a second roller, said first roller and said second roller being a finishing table, and by moving said first roller and said second roller apart so that said forming fabric extends in a substantially flat condition under tension between said first roller and said second roller.

3. The method as recited in claim 1 wherein mass is removed from the long-shute knuckle side of the forming fabric by means of an abrasive medium mounted on a rotating roll and brought into contact with said forming fabric.

4. The method as recited in claim 3 wherein the abrasive medium used is sandpaper.

5. The method as recited in claim 3 wherein the forming fabric is maintained in a substantially flat condition by placing said fabric in endless form around a first roller and a second roller, said first roller and said second roller being a finishing table, and by moving said first roller and said second roller apart so that said forming fabric extends in a substantially flat condition under tension between said first roller and said second roller of said finishing table, said first roller and said second roller of said finishing table moving the forming fabric in one direction while the rotating roll moves in the opposite direction.

6. The method as recited in claim 1 wherein a hand-held power sander is used to remove mass from the long-shute knuckle side of said forming fabric.

7. The method as recited in claim 1 wherein one-fourth of the mass on the long-shute knuckle side is removed.

8. A forming fabric treated in order to reduce edge curl in accordance with the method as recited in claim 1.

9. A method of reducing forming fabric edge curl comprising:

maintaining a forming fabric, having an upper surface, said upper surface supporting a paper sheet being formed when said forming fabric is in position of use on a papermachine, in a substantially flat condition; and removing mass from said upper surface of said forming fabric so that the ratio of the shrink forces acting in the cross-machine direction on and below said upper surface of said forming fabric will be reduced, said mass being removed from said upper surface in a band inwardly from an edge of said forming fabric for the length of said forming fabric.

10. The method as recited in claim 9 wherein said forming fabric is maintained in a substantially flat condition by placing said forming fabric in endless form around a first roller and a second roller, said first roller and said second roller being a finishing table, and by moving said first roller and said second roller apart so that said forming fabric extends in a substantially flat condition under tension between said first roller and said second roller.

11. The method as recited in claim 9 wherein mass is removed from said upper surface of said forming fabric by means of an abrasive medium mounted on a rotating roll and brought into contact with said forming fabric.

12. The method as recited in claim 11 wherein said abrasive medium used is sandpaper.

13. The method as recited in claim 11 wherein said forming fabric is maintained in a substantially flat condition by placing said forming fabric in endless form around a first roller and a second roller, said first roller and said second roller being a finishing table, and by moving said first roller and said second roller apart so that said forming fabric extends in a substantially flat condition under tension between said first roller and said second roller of said finishing table, said first roller and said second roller of said finishing table moving said forming fabric in one direction while said rotating roll moves in the opposite direction.

14. The method as recited in claim 9 wherein a hand-held power sander is used to remove mass from said upper surface of said forming fabric.

15. The method as recited, in claim 9 wherein one-fourth of the mass on said upper surface of said forming fabric is removed.

16. A forming fabric treated in order to reduce edge curl in accordance with the method as recited in claim 9.

* * * * *

UNITED STATES PATENT AND TRADEMARK OFFICE

CERTIFICATE OF CORRECTION

PATENT NO. : 4,941,239

DATED : July 17, 1990

INVENTOR(S) : Thomas A. Fliss

It is certified that error appears in the above-indentified patent and that said Letters Patent is hereby corrected as shown below:

Cover page, Item [22], delete "February 14, 1987" and substitute therefor --February 14, 1989--.

Signed and Sealed this

Twenty-seventh Day of June, 1995

Bruce Lehman

*Attest:*

BRUCE LEHMAN

*Attesting Officer*

*Commissioner of Patents and Trademarks*